United States Patent [19]

Tomaro

[11] 4,081,135

[45] Mar. 28, 1978

[54] PULSATING SHOWER HEAD

[75] Inventor: Patrick M. Tomaro, Maplewood, N.J.

[73] Assignee: Conair Corporation, Edison, N.J.

[21] Appl. No.: 695,140

[22] Filed: Jun. 11, 1976

[51] Int. Cl.[2] ..... B05B 1/08

[52] U.S. Cl. ..... 239/102; 239/447; 239/449

[58] Field of Search ..... 239/101, 102, 383, 394, 239/447, 449

[56] References Cited

U.S. PATENT DOCUMENTS

| | | | |
|---|---|---|---|
| 2,878,066 | 3/1959 | Erwin | 239/383 |
| 3,473,736 | 10/1969 | Heitzman | 239/101 |
| 3,568,716 | 3/1971 | Heitzman | 239/383 X |
| 3,762,648 | 10/1973 | Deines et al. | 239/102 X |
| 3,801,019 | 4/1974 | Trenary et al. | 239/102 X |

*Primary Examiner*—Robert R. Song
*Assistant Examiner*—Michael Mar
*Attorney, Agent, or Firm*—Parmelee, Johnson, Bollinger & Bramblett

[57] ABSTRACT

A shower head is provided capable of producing a pulsating or steady spray. Water entering the shower head passes through a set of inlet orifices into a plenum chamber and drives a turbine-type rotor within the chamber. The rotor has water cutting vanes which alternately open and close one or more water outlets from the chamber. The water then passes from the water outlets to the user for pulsed spray, or is directed to smaller openings for steady spray.

In the pulsed spray condition the total water outlet opening area is about four times the area of the inlet orifices to the plenum chamber, resulting in low back pressure, rapid rotation of the rotor and so pulsating spray. In the steady spray the smaller openings have a total area approximating that of the plenum inlet orifices, resulting in a high back pressure within the plenum chamber. This high back pressure causes the chamber to fill with water and serves to slow or stop rotation of the rotor. This reduces the water cutting action of the vanes and so reduces or stops pulsation.

8 Claims, 6 Drawing Figures

PULSATING SHOWER HEAD

BACKGROUND OF THE INVENTION

It has become popular to provide shower heads which can be used either as a normal shower head or as a massaging, i.e., pulsating, shower head. In designing such a shower head, it is necessary to have some method of "chopping" the stream of water to give the pulsating effect; and the chopped stream of water should be emitted from the shower head through relatively large holes to produce "bulk" in the pulsed water and, therefore, a better massage-type feeling. The shower head should also have an alternate steady-stream flow; there the water preferably passes through small holes to give a finer stream. Thus, it is better to have two sets of outlet holes and some control means for directing the stream of water to one or the other of the sets. In addition, there should be some method of "chopping" the water passing out of the large holes.

The prior art patents include a variety of pulsing techniques. One approach is to direct the incoming water to different flow passages to provide two flows of water. One flow goes through the chopping blade of a turbine, and the other bypasses the chopping blade and is a steady-state flow. The nature of the outlet water flow is determined by controlling the amount of flow through the passages. Another approach is to divide all the water into two paths, one through a cylindrical chopping unit operated by a turbine and the other through a by-pass. The water then goes through a valve controlling the output from the paths and then into a plenum chamber and to outlets. All of the water, whether pulsed or steady, passes through the same outlet openings.

Prior art patents relating to this field include:

| | |
|---|---|
| 1,609,047 | Beale |
| 2,878,066 | Erwin |
| 3,473,736 | Heitzman |
| 3,568,716 | Heitzman |
| 1,101,804 | Lauder |
| 3,801,019 | Trenary et al. |
| 3,920,185 | Kwok. |

In my U.S. Pat. No. 3,963,179 issued June 15, 1976, I have described yet another approach toward producing pulsating and steady-state streams of water for a shower head. There, all of the incoming water enters a common plenum chamber which contains a rotor or spinner, rotated by the incoming water. The spinner has chopping vanes which alternately open and close one or more exit openings from the plenum chamber so that all of the water leaving the plenum is "chopped" or pulsed. The water may then either leave the shower head directly to produce a pulsating spray or may be led through depulsing channels to fine outlet openings for a steady spray.

The present invention is a change over my earlier invention in that the water flow entering and leaving the plenum chamber affects the speed of rotation of the rotor and so affects the extent of the chopping of the exiting water. This enhances the efficiency of the unit both by increasing the sharpness of the pulsed spray and also by improving the steadiness of the steadystate spray. Under some circumstances the user may find this control means sufficient by itself to produce pulsating and steady-state sprays of a type satisfactory for normal use.

SUMMARY OF THE INVENTION

This invention provides a shower head which can deliver either a pulsating spray, through relatively large holes, or a steady spray through a series of smaller holes. The water is pulsed, but the degree of pulsation varies and the pulsation is reduced or even brought to a substantially steady flow when no pulsing or massaging effect is desired by the user.

To accomplish this, the housing of the shower includes a chamber containing a turbine-type rotor. The water, in entering the chamber, enters through a set of inlet orifices tangentially positioned to drive turbine blades on the rotor. The rotor includes chopping vanes that serve to open and close water outlet holes as the rotor revolves. All of the water used in the shower leaves through these outlets.

After being chopped by the vanes on the rotor, the water may either leave the shower head directly through large water outlets or be directed to a set of small outlet holes. The directing means may include a depulsing channel.

I have found that by varying the nature of the outlets and passages followed by the water, I can vary the back pressure on the water in the plenum chamber. This affects the speed of rotation of the rotor and thereby the degree of chopping or pulsation of the water leaving the plenum chamber.

"Back pressure" as I view it, is the resistance to water flow resulting from the nature of the flow passages. By varying the amount of resistance on the water leaving the plenum chamber, one varies the ease with which the water can leave the plenum chamber. If there is little resistance, i.e., little back pressure, water will leave the plenum chamber relatively easily and there will be little water in the chamber at any time. On the other hand, if there is greater back pressure, water will build up in the chamber even to the extent of having the chamber full of water at all times. A straight, wide passage with large outlet holes offers reduced resistance; by contrast, small outlet holes, possibly approached through a tortuous path, offer greater resistance.

If the plenum chamber has a small amount of water in it, the rotor has less resistance to rotation and will spin more rapidly causing faster chopping of the exiting water, i.e., more rapid pulsations. On the other hand, if the chamber has more water in it or is full of water, this will slow rotation of the spinner and tend to block direct impingement of water on the turbine blades of the rotor. As a result the rotor's speed will be reduced, and, under some circumstances, may even stop. Thus, increased back pressure will cause pulsation to be substantially reduced or even stopped. This, then, will give a more even steady-state outlet spray.

Variation of back pressure can, of course, be achieved in various ways. One method which I have found successful is to vary the total area of the holes through which water enters the chamber relative to the area of the holes through which water leaves the shower head. For example, if the ratio of the outlet area to the inlet area in the usual domestic shower head is at least about four to one, rapid pulsing will occur. If that ratio approximates unity there will be substantially reduced pulsing.

Utilization of variation of back pressure serves to enhance the efficacy of a shower head such as the one shown in my pending application Ser. No. 614,937.

THE DRAWINGS

DETAILED DESCRIPTION OF THE INVENTION

Figures 1, 2, 3:
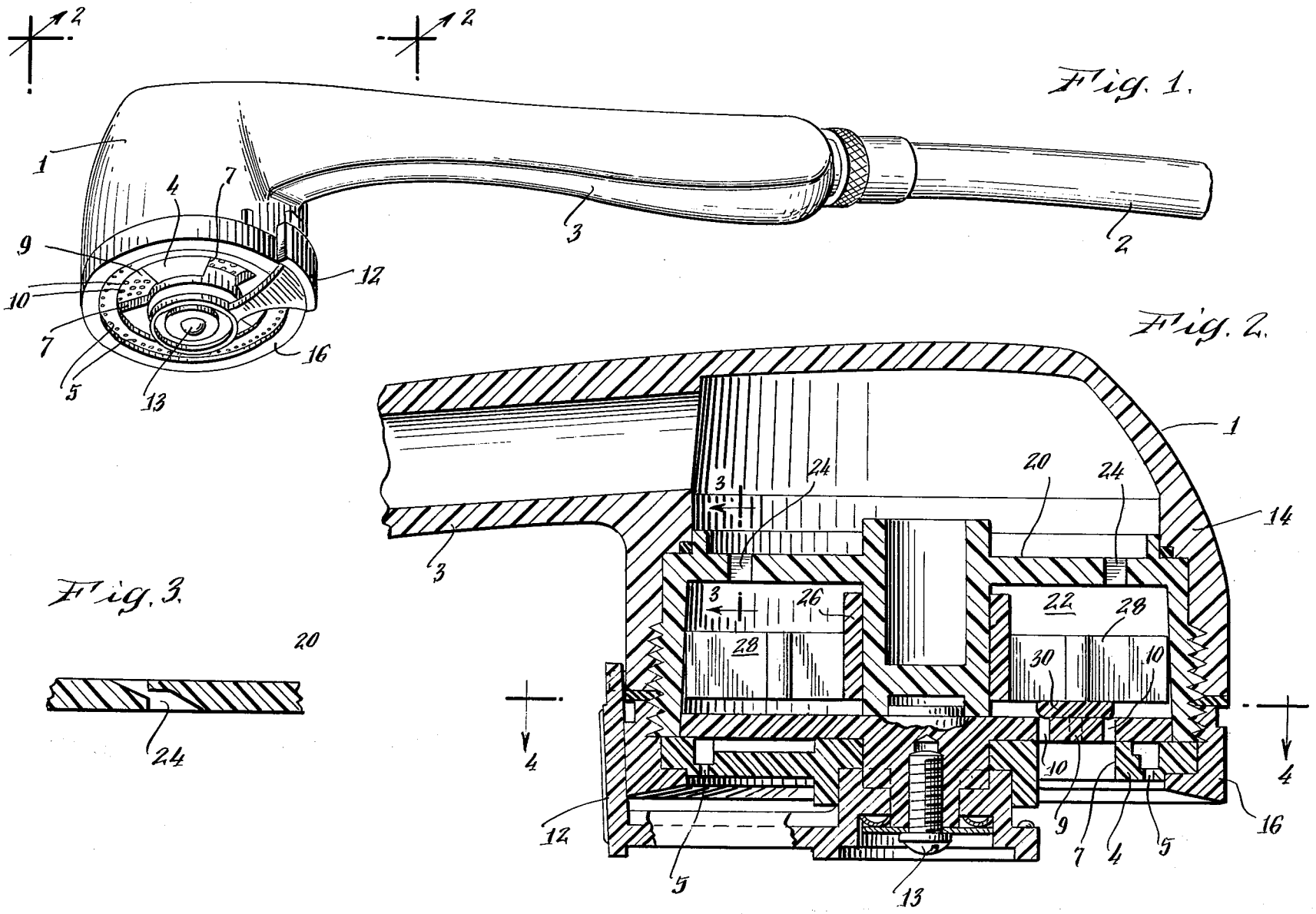
FIG. 1 is a perspective view of the shower head of the invention. It is shown as a hand-held type of unit, though it could also be fixedly mounted in a shower stall.
FIG. 2 is a cross-sectional view of the shower head (taken on line 2—2 of FIG. 1). It shows the plenum chamber, the inlet for the water, the spinner, chopping vanes, and the exit openings.
FIG. 3 is a section of one of the inlet openings (taken on line 3—3 of FIG. 2), showing how the incoming water is directed tangentially so that it can drive the turbine blades of the spinner.

The shower head of the invention is identified generally by the numeral 1. It includes a water inlet hose 2, a hollow handle 3 used as a water inlet, a housing 14, and a face plate or outer cover 4 at the outlet side of the housing. The face plate 4 includes peripheral holes 5 through which a fine steady stream of water may pass. It also includes three large holes 7 inside the peripheral holes and spaced equidistantly from one another.

Figure 6:
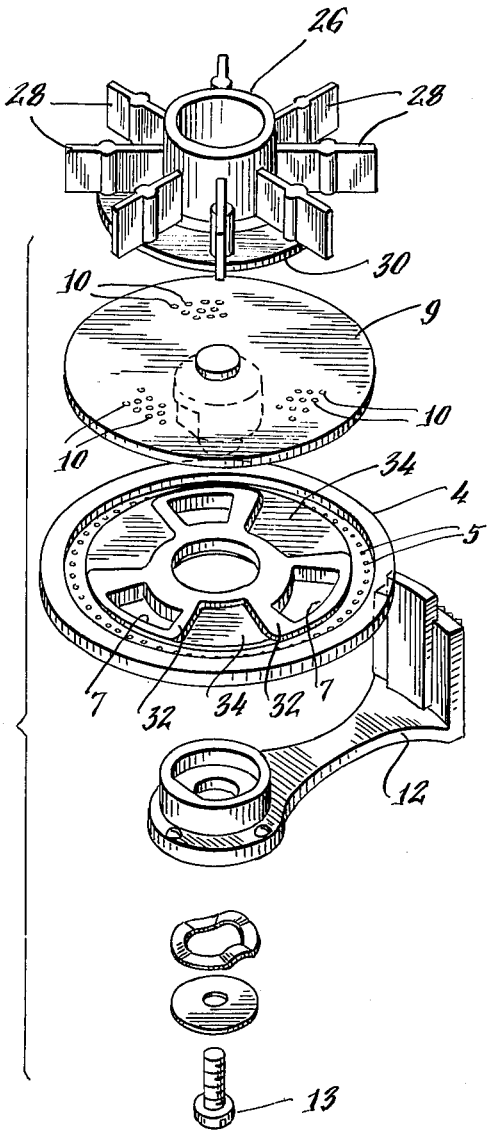
FIG. 6 is an exploded prespective view of the internal workings of the unit.

Control plate 9 is mounted inside face plate 4, for pivotal movement from one position to another. Plate 9 includes several sets of water outlet holes 10 which are larger than peripheral holes 5 and positioned so that will be in line with the large inner holes 7 in plate 4 when the control plate is rotated to the proper position. (Preferably each of holes 7 is large enough to encompass all of one set of holes 10.) Associated with control plate 9 is control handle 12, adapted to be rotated through about 60 degrees so holes 7 can be either in or out of alignment with outer holes 10 depending upon the desired type of stream. It is through outlet holes 10 that the heavy pulsed spray passes (see FIG. 6).

Face plate 4 and control plate 9 are held in position at the outlet end of housing 14 by a retaining cup or ring 16.

A wall 20 parallel to plate 9 is positioned in housing 14 inwardly of control plate 9. Wall 20, plate 9 and portions of housing 14 define a cylindrical inner plenum chamber 22. Water entering the shower head through hose 2 and handle 3 passes through a series of inlet orifices 24 in wall 20. These orifices are uniformly spaced in a circle on wall 20 and, preferably, are eight in number. Orifices 24 are set at an angle so that the incoming water is directed essentially tangentially to rotor blades 28 on the turbine-type rotor or spinner 26 (described below).

All of the water that enters plenum chamber 22 through orifices 24 leaves through outlet holes 10 in control plate 9. Depending upon whether the water is to be pulsed, control plate 9 is so positioned that the water leaving through outlet holes 10 can either pass directly through holes 7 in face plate 4 or indirectly through the smaller peripheral holes 5 in face plate 4.

Spinner or rotor 26 is mounted for rotational movement within plenum chamber 22. Spinner 26 includes a series of turbine-type blades 28 positioned to be hit by the water entering chamber 22 through orifices 24, causing spinner 26 to rotate. Cutting vane 30 is secured to the lower portion of spinner 26 and blades 28, transverse to the spinner's axis. Vane 30 is preferably circular and extends for about 180° around the circumference of spinner 26. It is so positioned that, as spinner 26 rotates, vanes 30 serve to cover, i.e. close, and uncover, i.e. open, outlet holes 10. This causes the water leaving the plenum chamber 22 through holes 10 to be pulsed.

Control handle 12 is secured by means of an axially positioned screw 13 to control plate 9, so that rotation of handle 12 rotates control plate 9. The inner surface of face plate 4 has a series of raised portions or ribs 32 surrounding holes 7 which, together with the adjacent surface of control plate 9, serve to form channels 34 leading to peripheral holes 5. Thus it can be seen that water leaving chamber 22 is cut by vanes 30 as it goes through large holes 10 and, depending upon the relative position of control plate 9, either passes as a pulsed spray directly to the user or passes into the channels 34 formed by ribs 32 and leaves through holes 5.

Aside from the use of a different type of rotor and modified vane, and back pressure aspects, the above structure resembles much of the disclosure of my prior application Ser. No. 614,937.

I have, however, found that the ease or lack of ease by which the water can leave the shower head relative to the ease with which it can enter through orifices 24 can have an effect upon the sharpness and rate of pulses and upon the efficacy of the depulsing during steady-stream operation. I refer to this relative resistance to the exiting of water as "back pressure". Variation in back pressure can be created by relative size of holes for entry and exit of the water, by the use or non-use of a more tortuous path for the exit of the water, or by a combination of both. The important thing is that there be less back pressure in those instances where one wishes a pulsed stream than when one wishes to have a steady-state stream. If back pressure alone is to determine whether the stream is pulsed or steady, the extent of change in back pressure must be sufficient to create this result.

Experiment can readily show the proper amount and variation of back pressure to be used in a shower head of a given size and configuration. By way of example, however, in a structure as described above, I have found that to obtain sharp and fast pulsing, the ratio of outlet area to inlet area of the holes must be large enough to allow the water to leave plenum chamber 22 readily and not tend to fill it; and, for steady state, the ratio should be small enough so that it is more difficult for the water to leave; plenum chamber 22 tends to fill with water. Reduced quantities of water in chamber 22 permit more rapid rotation of spinner 26 and also allow the water entering through inlet orifice 24 to strike rotor blades 28 more directly (and so more efficiently). Increased quantities of water, by contrast, impedes rotation of spinner 26 and interferes with the incoming water striking blades 28. Slow rotation of spinner 26 cuts down the chopping rate and so the pulsing rate caused by vanes 30 crossing outlet holes 10; it may even cause pulsing to stop altogether. On the other hand, faster rotation, i.e. with less water in chamber 22, increases the spinning rate of rotor 26, and, consequently, vanes 30 cut or pulse the water going through holes 10 more sharply and rapidly.

By way of example, the structure shown in the figures described above has a plenum chamber approximately two and a half inches in internal diameter and three quarters of an inch in depth. It has eight evenly spaced orifices 24 to permit water to enter the chamber and has three groups (120° apart) of ten outlet holes 10 in control plate 9. Vane 30 is a semi-circle of 180° on the base of vanes 30. The total cross-sectional area of the inlet orifices is 0.037 square inches, and the total area of outlet holes 10 is 0.150 square inches, giving an inlet to outlet ratio of approximately 1 to 4. This latter condition allows the rotor to spin within the chamber 22 most readily, since the outlet area is large, preventing a back pressure build up. It produces a pulsed spray.

For a steady-stream spray the water is directed from holes 10 radially out through channels 34 to small peripheral holes 5 in plate 4. By the use of 45 holes 5 having a total crosssectional area of 0.043 square inches the ratio of inlet orifice area to outlet spray hole area is approximately 1 to 1.16, i.e. close to unity. Depending upon the water pressure in the system, this will cause the spinner either to rotate very slowly or to come to a complete stop.

As can be seen in the structure described, there is additional back pressure created in the steady-stream mode because the water passes from holes 11 through channels 34 before reaching peripheral holes 5. The extent to which these channels are so designed as to create back pressure for depulsing purposes may vary with the relative size of inlet holes 24 and peripheral outlet holes 5. As can be seen by adjusting the relative size of the inlet and outlet holes, one can control the back pressure and so control the amount of pulsing or non-pulsing. If depulsing channels 34 are used, peripheral holes 5 can be larger. If holes 5 are reduced to a small enough size, it may be unnecessary to use depulsing channels 34 because the back pressure will be adequate to slow or substantially stop rotation of spinner 26 and vanes 30.

As can be seen, by use of a plenum chamber containing the rotor and its chopping vane, control of relative back pressure will control rotor speed. Variations may readily be designed falling within this concept by relatively simple engineering design or experimentation.

OPERATION

In operation shower head 1 is connected to a water supply through hose 2, and the control valve (not shown) is turned on. Water than passes through hose 2 and handle 3 into housing 14 where it enters plenum chamber 22 through tangentially-oriented orifices 24.

Water leaving orifices 24 is directed against turbine blades 28 on spinner 26, causing the spinner to rotate. This rotation causes vane 30 to sequentially open and close the outlet holes 10 in control plate 9 causing the water to pulse as it goes through holes 10.

Figure 4:
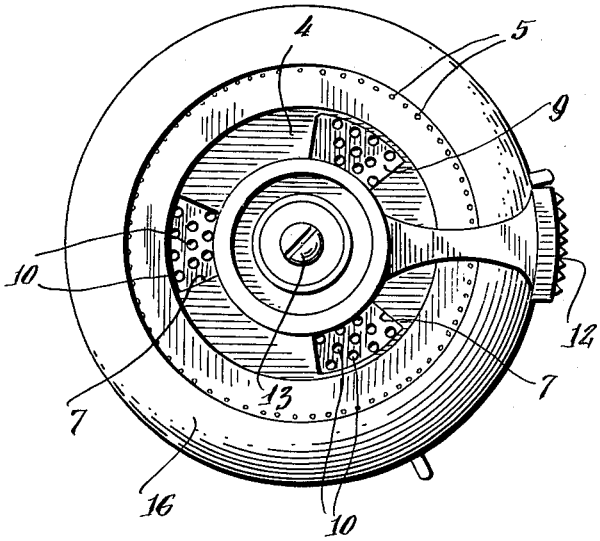
FIG. 4 is a view looking directly at the face of the shower head outlet. It shows the two sets of outlet holes and a control arm to select which outlet holes are to be used.

If control arm 12 is in the position such that the large inner holes 7 in face plate 4 are in alignment with outlet holes 10 (see FIG. 4), the water will leave the shower head directly. It will be a pulsed stream.

Figure 5:
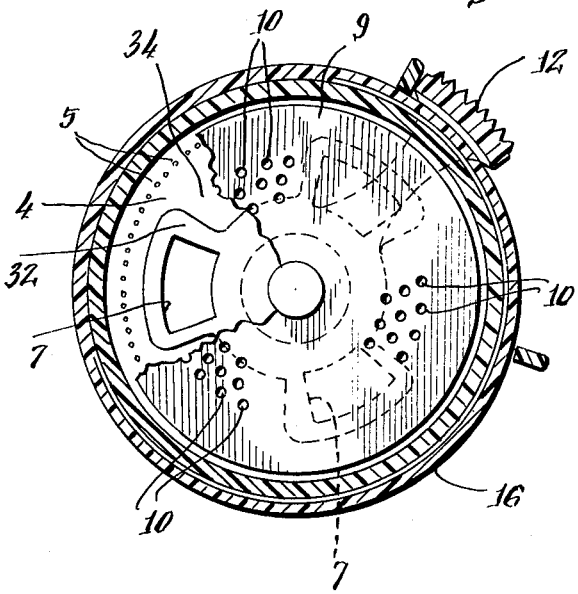
FIG. 5 is similar to FIG. 4 but as viewed from inside. It is a section taken on line 4—4 of FIG. 2.

If control arm 12 is moved so that outlet holes 10 are not aligned with the large holes 7 in control plate 9 (see FIG. 5), then the water has to pass through channels 34 to the peripheral holes 5. Under these circumstances there is considerably more back pressure in the unit so that the water does not leave plenum chamber 22 as readily. The result is a sluggishness in action of spinner 26 so that the chopping or pulsing caused by vane 30 is substantially reduced or, under some circumstances, even stopped. Consequently, the water leaving holes 5 provides a steady rather than a pulsed stream.

Control arm 12 may also be set at intermediate positions. This will permit variation of the back pressure from the maximum to the minimum allowed by the design of the unit. This will cause intermediate speeds of rotation of spinner 20 and so intermediate rates of pulsation. It will also result in an output which is a mixture of pulsed and steady streams.

I claim:

1. A shower head for producing water sprays with varying degrees of pulsation including a shower head housing, a chamber within said housing, said chamber having a chamber water inlet and a chamber water outlet, a rotor mounted for rotation within said chamber, said rotor including turbine blades to cause rotation of same, said blades being positioned to receive water entering said chamber through said chamber inlet, said rotor including a chopping vane positioned so as to cut all water leaving said chamber through said chamber outlet to create pulsation of the water, and means for varying the back pressure in said chamber sufficiently to vary the rate of rotation of said rotor and thereby vary the degree of water pulsation, said pressure varying means including means for changing the size of said chamber inlet relative to said chamber outlet and means for providing a more tortuous path for the water passing through said chamber outlet when said shower head is set for a steady-state stream.

2. A shower head as in claim 1 in which the relative size of sad chamber inlet and said chamber outlet vary from about 1 to 4 to about 1 to 1.

3. A shower head for producing water sprays with varying degrees of pulsation including a shower head housing, a chamber within said housing, said chamber having a chamber water inlet and a chamber water outlet, a rotor mounted for rotation within said chamber, said rotor including turbine blades to cause rotation of same, said blades being positioned to receive water entering said chamber through said chamber inlet, said rotor including a chopping vane positioned so as to cut all water leaving said chamber through said chamber outlet to create pulsation of the water, and means for changing the size of said chamber inlet relative to said chamber outlet to vary the back pressure in said chamber sufficiently to vary the rate of rotation of said rotor and thereby vary the degree of water pulsation, said size changing means including means for changing the area of said chamber outlet sufficiently to remove substantially all the pulsations and thereby provide a more steady stream of water.

4. A shower head adapted to produce pulsed or steadystream sprays, said head including a housing having an inlet opening to receive water, a face plate on said housing, an inner wall within said housing defining a plenum chamber therein between said wall and said face plate, said plenum chamber having at least one inlet orifice and a first set of outlet holes, a spinner having turbine blades and being mounted for rotational movement within said chamber, said spinner having at least one chopping vane therein positioned to cut water leaving through said outlet holes, said inlet orifice being so positioned and directed as to cause inlet water to be impelled against said turbine blades to rotate said spinner and thereby cause said chopping vane to pulse water leaving said outlet holes, the ratio of total area of all said inlet orifices to said outlet holes being such that back pressure in said plenum chamber is low enough to permit rotation of said spinner rapidly enough so that the water leaving said plenum chamber will be pulsed, a second set of outlet holes having a total area sufficiently smaller than the total area of said first set of outlet holes as to cause said plenum chamber to fill with water sufficiently to reduce the rate of rotation of said spinner and thereby reduce the rate of pulsation of water leaving said plenum chamber, and means to direct water to said second set of outlet holes.

5. A shower head as in claim 4 in which said ratio of total area of all said inlet orifices to said first set of outlet holes is no greater than about 1 to 4 and in which the ratio of total area of all said inlet orifices to that of said second set of outlet holes is about 1 to 1.

6. A shower head as in claim 4 in which said means to direct water to said second set of outlet holes is so dimensioned to create additional back pressure.

7. A shower head as in claim 4 in which said means to direct water to said second set of outlet holes is a control plate mounted for positioning in at least two positions, and means associated with said control plate for allowing water to flow directly out said first set of outlet holes when said control plate is in one position and, when in another position, for preventing such flow and directing the water to said second set of outlet holes.

8. A shower head for producing water sprays with varying degrees of pulsation including a shower head housing, a chamber within said housing, said chamber having a chamber water inlet and a chamber water outlet, a rotor mounted for rotation within said chamber, said rotor including turbine blades to cause rotation of same, said blades being positioned to receive water entering said chamber through said chamber inlet, said rotor including a chopping vane positioned so as to cut water leaving said chamber through said chamber outlet to create pulsation of the water, and means for changing the size of said chamber inlet relative to said chamber outlet to vary the back pressure in said chamber sufficiently to vary the rate of rotation of said rotor and thereby vary the degree of water pulsation, said means including means for changing the area of said chamber outlet including a water outlet having a smaller outlet area than said first named water outlet and means for directing water leaving said chamber to said outlet with said smaller area.

* * * * *

UNITED STATES PATENT OFFICE

CERTIFICATE OF CORRECTION

Patent No. 4,081,135 Dated March 28, 1978

Inventor(s) Patrick M. Tomaro

It is certified that error appears in the above-identified patent and that said Letters Patent are hereby corrected as shown below:

Column 6, line 40, "sad" to read --- said ---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*